United States Patent [19]

Clementini et al.

[11] Patent Number: 4,636,436

[45] Date of Patent: Jan. 13, 1987

[54] TEXTILE FIBERS BASED ON MODIFIED OLEFINIC POLYMERS

[75] Inventors: Luciano Clementini; Pier P. Camprincoli, both of Terni, Italy

[73] Assignee: Montedison S.p.A., Milan, Italy

[21] Appl. No.: 563,588

[22] Filed: Dec. 20, 1983

[30] Foreign Application Priority Data

Dec. 22, 1982 [IT] Italy ..... 24902 A/82

[51] Int. Cl.[4] ..... D02G 3/00

[52] U.S. Cl. ..... 428/364; 428/402; 525/333.7; 525/380; 525/384

[58] Field of Search ..... 428/364, 402; 8/DIG. 9, 8/928; 525/333.7, 380, 384, 301, 193

[56] References Cited

U.S. PATENT DOCUMENTS

| | | | |
|---|---|---|---|
| 3,320,226 | 5/1967 | Cappuccio et al. | 525/333.7 |
| *3,553,176 | 1/1971 | Fujisaki et al. | 525/333.7 |
| 4,219,432 | 8/1980 | Girgenti et al. | 525/301 |

FOREIGN PATENT DOCUMENTS

| | | | |
|---|---|---|---|
| 0021726 | 6/1971 | Japan | 525/333.7 |

*Primary Examiner*—Marion C. McCamish

[57] ABSTRACT

Hydrophilic textile fibers, which exhibit good receptivity to dyes of the disperse class are prepared from crystalline olefin polymers modified by carboxylic acids, grafted along the polymer chain, by reaction with polyamides, polyamines, polyoxyethylene alcohols or polyoxyethylene amines which react with the carboxylic acids and processes for obtaining such fibers are disclosed.

8 Claims, No Drawings

TEXTILE FIBERS BASED ON MODIFIED OLEFINIC POLYMERS

BACKGROUND OF THE INVENTION

It is known in the prior art to prepare hydrophobic modified crystalline olefin polymers having good receptivity for dispersed dyes. Various processes for preparing such hydrophobic fibers from crystalline olefin polymers modified with unsaturated acids have been disclosed.

By "modified polymers" is meant such polymers which contain free functional groups grafted along the polymer chain and which impart particular chemical and chemical-physical characteristics to the olefin polymer.

Process for preparing the hydrophobic fibers is described e.g., in a recent patent application in the name of the Applicants. Said process consists in grafting carboxylic groups on crystalline olefin polymers by subjecting the polymer to a preliminary treatment with an organic peroxide and then reacting with an unsaturated carboxylic acid in the presence of an organic peroxide having different reactivity than that used in the preliminary treatment.

Such fibers, when subjected to the test of the measure of immersion time, which consists of introducing 1 g of fibers into a liter of distilled water at 25° C. do not exhibit any hydrophilic characteristics even after long immersion times up to one hour.

THE PRESENT INVENTION

One object of this invention is to provide textile fibers of modified crystalline olefin polymers which are both hydrophilic and receptive to disperse dyes.

Another object is to provide processes for preparing such hydrophilic fibers.

These and other objects as will appear infra are achieved by reacting the crystalline olefin polymers modified by carboxylic acids with compounds capable of reacting with the carboxylic groups present along the polymer chain and which are selected from polyamides, polyamines, polyoxyethylene alcohols of formula:

$$R—O(CH_2CH_2O)_n—H$$

and polyoxyethylene amines of formula:

$$R—N[(CH_2CH_2O)_nH]_2$$

in which formulae

R is an alkyl radical containing 1 to 18 carbon atoms and n is an integer in the range 1 to 50.

The reaction of the compounds reactive with the carboxylic groups of the starting modified olefin polymer can be carried out in an aqueous or organic solvent solution or dispersion of said compounds, at temperatures ranging from 40° C. to 150° C. for times varying from 10 minutes to five hours.

The reaction may be conducted in the presence of stabilizers, opacifiers, pigments, other non-modified polyolefins, and antioxidants, and other adjuvants of the kind commonly used in this art.

One suitable antioxidant is pentaerythritoltetra-3(3,5-di-ter-butyl-4-hydroxyphenyl)-propionate. Instead of fibers, the modified olefin polvmer may be used as transformation product of different form, e.g., a film, web., etc.

Another method of effecting the reaction according to the invention is to treat the modified polyolefin polymer in the molten state with the compounds reactive with the carboxylic groups in a mixer and in the absence of solvents before extruding the modified polymer into fibers or other manufactured shaped articles, in general.

In a presently preferred embodiment of the invention, the compounds reactive with the carboxylic groups of the starting modified polymer are selected from di-2-oxyethylene-n-dodecylamine; di-2-oxyethylene-n-octadecylamine; n-dodecylpolyoxyethylene alcohol; and n-octadecyl-polyoxyethylene alcohol.

Crystalline olefin polymers useful in the practice of a presently preferred embodiment of the present invention are obtained by polymerization of olefins, $CH_2{=}CHR$, in which R is H or an alkyl radical containing 1 to 6 carbon atoms, mixtures of said olefins with ethylene, or mixtures of the olefins $CH_2{=}CHR$ in which R is alkyl with each other.

In particular, the olefin polymer is polyethylene, crystalline polypropylene having a high isotacticity index, and random or block crystalline copolymers of ethylene and propylene having a propylene content higher than 80% by weight.

The crystalline olefin polymer which is modified and then reacted in accordance with this invention can be prepared by different methods.

Thus, the crystalline olefin polymer can be obtained, for example, by polymerizing the monomer in the presence of a catalyst based on $TiCl_3$, or of a high-yield catalyst based on a Ti compound supported on a Mg dihalide in active form.

The polymerization can be carried out in liquid phase in the presence or absence of an inert hydrocarbon solvent, such as, e.g., hexane or heptane.

The olefin polymers may be in the form of flakes, i.e., in the form of particles having for at least 80% an average size above 250 microns and free from fine particles having sizes below 100 microns. The polymers in the form of flakes are obtained by polymerization of the olefin with controlled-granulometry co-ordination catalysts.

"Co-ordination catalysts" means the products obtained by reaction of an organometallic compound of a metal belonging to groups I-III of the Mendelyeev periodic system with a titanium compound.

The catalyst can be prepared either from $TiCl_3$ in the form of controlled-granulometry particles obtained from $TiCl_4$ by reduction with aluminum-alkyl compounds, or from controlled-granulometry catalytic components obtained by supporting a titanium compound on magnesium halides in the active form.

Examples of the above said catalysts are those described in U.S. Pat. No. 4,227,371 or in British Pat. No. 1,434,543.

Examples of unsaturated acids employable in the grafting reaction, carried out according to conventional methods, include acrylic acid, maleic acid, fumaric acid, itaconic acid, methacrylic acid and crotonic acid.

Acrylic acid and methacrylic acid are the presently preferred compounds.

The fibers are obtained from the modified polymers by spinning and stretching according to conventional processes.

The fibers are obtainable in the form of continuous filaments or of staples, as well as in the form of texturized thread or of bulky or spun-bonded yarn.

Among the solvents suitable for suspending the modified polymers or the transformation products thereof, such as fibers and films, for the reaction with compounds reactive with the carboxylic groups of the modified polymers, are water and the organic solvents, such as alcohols, ketones, esters and hydrocarbons.

The fibers obtained by the process of the invention exhibit an immersion time shorter than 300 seconds.

The following examples will further illustrate the present invention. In these examples the dyeing operations were conducted for 1 hour and 30 minutes under boiling, in dyebaths containing 2.5% of dyestuff of the dispersed dye classes with respect to the fiber weight, with fiber/dye-bath ratio of 1:40.

The examples are given for illustrative purposes only and are not limiting of the invention.

EXAMPLE 1

A mix was prepared by mixing 100 kg of crystalline polypropylene modified with acrylic acid, having an acrylic acid content of 0.48% by weight and a melt index (M.I.), determined according to standards A.S.T.M. D 1238-L, of 7.5 g/10 min., and, as antioxidant, 150 g of pentaerythritoltetra-3-(3,5-di-ter.butyl-4-hydroxyphenyl)-propionate.

The mix was granulated by extrusion at 200° C. and the granulated product was spun under the following operating conditions:

| | | |
|---|---|---|
| spinning: | screw temperature | 220° C. |
| | head temperature | 220° C. |
| | spinneret temperature | 220° C. |
| | spinneret type | 300 nozzles, each of them having a diameter of 1 mm and a length of 20 mm |
| | maximum pressure | 45 kg/cm$^2$ |
| | windup speed | 500 m/minute |
| stretching: | temperature (steam medium) | 100° C. |
| | stretch ratio | 1:3.2 |

The fibers obtained exhibited the following characteristics:

| | |
|---|---|
| count (dtex) | 16.8 |
| tenacity (g/dtex) | 2.4 |
| elongation (%) | 180. |
| immersion time (sec.) | no immersion. |

The fibers were treated at 100° C. for 2 hours with 100 ml per gram of fiber of an aqueous solution at 1% by weight of di(2-oxyethylen)-n-octadecylamine.

After said treatment, the fibers exhibited an immersion time of 15 seconds.

Furthermore, the fibers were endowed with a good receptivity for the following disperse dyes:

| | |
|---|---|
| disperse yellow | C.I. 23 |
| disperse red | C.I. 54 |
| disperse blue | C.I. 56. |

EXAMPLE 2

Example 1 was repeated but using, as a compound reactive with the carboxylic groups of the modified polymer, 100 ml per gram of polymer of an aqueous solution at 5% of n-octadecyl(polyoxyethylen)alcohol with 19 oxyethylene units.

After said treatment, the fibers showed an immersion time of 120 seconds and a good receptiveness to the dyes of Example 1.

EXAMPLE 3

Example 1 was repeated but using, as a compound reactive with the carboxylic groups of the polymer, 100 ml per gram of polymer of an aqueous solution at 5% of n-dodecyl(polyoxyethylen)alcohol with 12 oxyethylene units.

After said treatment, the fibers showed an immersion time of 180 seconds and a good receptiveness to the dyes of Example 1.

EXAMPLE 4

Example 1 was repeated but using, as a compound reactive with the carboxylic groups of the polymer, 100 ml per gram of polymer of an aqueous solution at 1% of di(2-oxyethylen)-n-dodecylamine.

The fibers showed, after the treatment, an immersion time of 60 seconds and a good receptiveness to the dyes of Example 1.

EXAMPLE 5

There was prepared a mix consisting of 97 kg of crystalline polypropylene modified with acrylic acid (0.24% by weight of acrylic acid) and having a melt index=9 g/10 minutes, of 3 kg of di-(2-oxyethylen)-n-octadecylamine and of 100 g of pentaerythritoltetra-3-(3,5-di-ter.butyl-4-hydroxyphenyl) propionate, as an additive acting as antioxidant. The mix was granulated by extrusion at 200° C., and the granulated product was spun under the following operating conditions:

| | | |
|---|---|---|
| spinning: | screw temperature | 225° C. |
| | head temperature | 225° C. |
| | spinneret temperature | 230° C. |
| | spinneret type | 300 holes, each of them having a diameter of 1 mm and a length of 20 mm |
| | maximum pressure | 35 kg/cm$^2$ |
| | windup speed | 500 m/minutes. |
| stretching: | temperature (medium steam) | 100° C. |
| | stretch ratio | 1:3.2 |

The fibers obtained showed the following characteristics:

| | |
|---|---|
| count (dtex) | 16.8 |
| tenacity (g/dtex) | 3.0 |
| elongation (%) | 160. |
| immersion time (sec.) | 30. |

Furthermore, the fibers were endowed with a good receptiveness to the following dispersed dyes:

| | |
|---|---|
| disperse yellow | C.I. 23 |
| disperse red | C.I. 54 |
| disperse blue | C.I. 56. |

EXAMPLE 6

Example 5 was repeated but using, as a compound reactive with the carboxylic groups of the polymer, 3 kg of di-(2-oxyethylen)-n-dodecylamine at a maximum spinning pressure of kg/cm$^2$.

The fibers obtained showed the following characteristics:

| | |
|---|---|
| count (dtex) | 17. |
| tenacity (g/dtex) | 3.4 |
| elongation (%) | 170. |
| immersion time (sec.) | 45. |

The fibers showed a good receptivity for the dyes of Example 1.

EXAMPLE 7

Example 5 was repeated but using, as the compound reactive with the carboxylic groups, 3 kg of n-dodecyl(-polyoxyethylen)-alcohol with 12 oxyethylene units and a maximum spinning pressure of 38 kg/cm$^2$.

The fibers obtained had the following characteristics:

| | |
|---|---|
| count (dtex) | 16.9 |
| tenacity (g/dtex) | 3.2 |
| elongation (%) | 180. |
| immersion time (sec.) | 65. |

The fibers exhibited a good receptivity for the dyes of Example 1.

EXAMPLE 8

Example 5 was repeated but using, as the compound reactive with the carboxylic groups, 3 kg of n-octadecyl-(polyoxyethylen)-alcohol with 19 oxyethylene units and a maximum spinning pressure of 39 kg/cm$^2$.

The fibers obtained exhibited the following characteristics:

| | |
|---|---|
| count (dtex) | 16.8 |
| tenacity (g/dtex) | 3.1 |
| elongation (%) | 175. |
| immersion time (sec.) | 75. |

The fibers showed a good receptiveness for the disperse dyes of Example 1.

EXAMPLE 9

Example 5 was repeated but using 50 kg of polypropylene modified with acrylic acid (0.48% by weight of acrylic acid in the polymer, M.I.=7 g/10 min.), 47 kg of crystalline polypropylene (isotacticity index=98.3%, M.I.=12 g/10 min.) and 3 kg of di-(2-oxyethylen)-n-dodecylamine and employing a maximum spinning pressure of 32 kg/cm$^2$.

The fibers obtained showed the following characteristics:

| | |
|---|---|
| count (dtex) | 16.9 |
| tenacity (g/dtex) | 3.5 |
| elongation (%) | 160. |
| immersion time (sec.) | 50. |

The fibers had good receptiveness for the dyes of Example 1.

EXAMPLE 10

Example 9 was repeated but using 3 kg of di-(2-oxyethylen)-n-octadecylamine as the compound reactive with the carboxylic groups of the polymer and a maximum spinning pressure of 35 kg/cm$^2$.

| | |
|---|---|
| count (dtex) | 17. |
| tenacity (g/dtex) | 3.1 |
| elongation (%) | 170. |
| immersion time (sec.) | 40. |

The fibers showed a good receptivity for the dyes of Example 1.

EXAMPLE 11

Example 9 was repeated but using, as the compound reactive with the carboxylic groups 3 kg of n-dodecyl-(polyoxyethylene)-alcohol with 12 oxyethylene units, and a maximum spinning pressure of 38 kg/cm$^2$.

The fibers obtained had the following characteristics:

| | |
|---|---|
| count (dtex) | 16.8 |
| tenacity (g/dtex) | 3.3 |
| elongation (%) | 165. |
| immersion time (sec.) | 68. |

The fibers showed a good receptiveness for the dyes of Example 1.

EXAMPLE 12

Example 9 was repeated but using, as the compound reactive with the carboxylic groups 3 kg of n-octadecyl(polyoxyethylene)-alcohol with 19 oxyethylene units, and a maximum spinning pressure of 39 kg/cm$^2$.

The fibers obtained exhibited the following characteristics:

| | |
|---|---|
| count (dtex) | 16.9 |
| tenacity (g/dtex) | 3.4 |
| elongation (%) | 80. |
| immersion time (sec.) | 80. |

The fibers had a good receptivity for the dyes of Example 1.

We claim:

1. Fibers and films comprising the reaction product of (1) a crystalline olefin homopolymer or copolymer modified with an unsaturated carboxylic acid and (2) a compound reactive with the carboxylic groups and selected from the group consisting of polyamides, polyamines, polyoxyethylene alcohols of the general formula $$R—O(CH_2CH_2O)_nH$$

and polyoxyethylene amines of the formula $$R—N[(CH_2CH_2O)_nH]_2$$

in which general formulae R is an alkyl radical containing 1 to 18 carbon atoms and n is an integer ranging from 1 to 50.

2. Textile fibers according to claim 1.

3. Textile fibers according to claim 2, in which the modified crystalline olefin (co)polymers are obtained from (co)polymers prepared by polymerization of olefins $CH_2{=}CHR$, in which R is H or an alkyl radical with 1 to 6 carbon atoms, or mixtures of said olefins, in the presence of a co-ordination catalyst.

4. Fibers according to claim 3, in which the crystalline olefin polymers are selected from the group consisting of polyethylene, crystalline polypropylene having a high isotacticity index, and ethylene/propylene crystalline copolymers containing more than 80% by weight of propylene.

5. Fibers according to claim 3 in which the starting olefin polymers are in the form of particles having for at least 80% an average size above 250 micron.

6. Fibers according to claim 2, in which the polymers are modified with unsaturated acids selected from the group consisting of acrylic acid, methacrylic acid, fumaric acid, maleic acid, crotonic acid and itaconic acid.

7. Fibers according to claim 2, in which the compounds which are reacted with the modified olefinic polymers are selected from the group consisting of di-(2-oxyethylen)-n-dodecylamine, di-(2-oxyethylen)-n-octadecylamine, n-dodecyl-(polyoxyethylen)-alcohol and n-octadecyl-(polyoxyethylene)-alcohol.

8. A film according to claim 1.

* * * * *